US007895690B2

(12) United States Patent
Kovalyak

(10) Patent No.: US 7,895,690 B2
(45) Date of Patent: Mar. 1, 2011

(54) INFANT HUGGING AND COMFORTING DEVICE

(76) Inventor: Nicole L. Kovalyak, Dubois, PA (US)

( * ) Notice: Subject to any disclaimer, the term of this patent is extended or adjusted under 35 U.S.C. 154(b) by 0 days.

(21) Appl. No.: 12/320,779

(22) Filed: Feb. 4, 2009

(65) Prior Publication Data

US 2010/0192304 A1 Aug. 5, 2010

(51) Int. Cl.
*A47C 16/00* (2006.01)

(52) U.S. Cl. ..... 5/655

(58) Field of Classification Search ..... 5/655, 494; 128/869, 872, 876
See application file for complete search history.

(56) References Cited

U.S. PATENT DOCUMENTS

| | | | | |
|---|---|---|---|---|
| 4,790,042 | A * | 12/1988 | Reich | 5/655 |
| 5,551,109 | A * | 9/1996 | Tingley et al. | 5/655 |
| 5,826,287 | A * | 10/1998 | Tandrup | 5/655 |
| 5,970,542 | A * | 10/1999 | Mays | 5/485 |
| 6,193,678 | B1 * | 2/2001 | Brannon | 601/15 |
| 6,513,164 | B1 * | 2/2003 | Hearns | 2/69.5 |
| 6,658,681 | B2 * | 12/2003 | Britto et al. | 5/655 |
| 7,346,949 | B2 * | 3/2008 | Kamrin-Balfour | 5/655 |
| 2005/0000024 | A1 * | 1/2005 | Jakubowski | 5/655.3 |
| 2007/0122066 | A1 * | 5/2007 | Landay | 383/16 |

* cited by examiner

*Primary Examiner* — Robert G Santos
*Assistant Examiner* — Nicholas Polito
(74) *Attorney, Agent, or Firm* — Klima Law Offices, PLLC

(57) ABSTRACT

An infant hugging and comforting device including the combination of a cloth hugging device and a vibrating device. Preferably, the cloth hugging device has adjustable arm portions to accommodate different size infants, and allow the device to be fitted to a particular infant. Further, the vibrating device is preferably a separate device removably attached to the soft cloth hugging device.

15 Claims, 3 Drawing Sheets

INFANT HUGGING AND COMFORTING DEVICE

BACKGROUND OF THE INVENTION

Infants are typically swaddled after being born using a small light blanket. Swaddling an infant simulates the infant being inside the uterus of the mother, and typically comforts the infant so that the infant will rest and sleep.

There exists a need for a device configured to be easily and conveniently used to wrap around and hug the infant for providing comfort and a feel of security to the infant. This particularly important for colic infants, reflux infants, and drug withdraw infants.

The positioning aide or infant hugging and comforting device should be designed or configured to comfort such newborn infants, reflux infants, colicy infants, and drug withdraw infants. Infants are comforted by being held with arms wrapped around them. The infant hugging and comforting device should "re-create" or stimulate the baby being held, and optionally can be provided with vibration to provide additional comfort to the infant. The hugging and comforting device will aide in the infant getting to sleep and rest since it will sooth the infant as a comfort measure. The hugging or comforting device should be designed or configured so that the infant can be swaddled in a thin blanket, or can also be used without swaddling.

The advantages of an infant hugging and comforting device compared to just a "swaddling blanket" is "re-creating" or stimulating the arms of a human holding and comforting the infant as well as the option of vibration so that the infant can be put to sleep or held while using same. A regular blanket can be used to swaddle the infant but there is no "hugging" or "vibration" comfort that can be provided by the infant hugging and comforting device.

Medically for the reflux or drug withdrawal infant the goal is to get the infant calmed enough to be able to rest and be comforted. The reflux infant cries a lot due to being uncomfortable. The infant hugging and comforting device can be offered for these infants, and the vibration option as well for an added comfort measure. The parents may hold the infant and offer a pacifier if they wish until the infant goes to sleep. The infant may then be put down to get some rest in the infant hugging and comforting device. Infants have also been willing to go right to sleep with the infant hugging and comforting device without being held.

The drug withdrawal infant is most of the time inconsolable due to the withdrawal affect. The infant hugging and comforting device can be offered to these infants as a comfort measure. These infants seem to be comforted by the infant hugging and comforting device, and the vibration it offers. The goal for these infants is to get the infant into their dark, quite room for rest, not in the middle of a nursing unit being held by a nurse where it is bright and can be loud.

The positioning device or infant hugging and comforting device will allow the infant to rest more, be more comfortable, and will enable these infants to grow, eat better, and neurologically develop better.

SUMMARY OF THE INVENTION

A first object of the present invention is to provide an infant hugging device.

A second object of the present invention is to provide an infant comforting device.

A third object of the present invention is to provide an infant hugging and comforting device.

A fourth object of the present invention is to provide an infant hugging and comforting device configured to wrap around and hug an infant's chest.

A fifth object of the present invention is to provide an infant hugging and comforting device configured to wrap around and hug an infant's chest, and be adjustable in size and fit for the particular infant.

A sixth object of the present invention is to provide an infant hugging and comforting device including a back panel portion, a left panel portion, and right panel portion connected to the back panel portion.

A seventh object of the present invention is to provide an infant hugging and comforting device including a back panel portion, a left panel portion having a left arm portion and a right panel portion having a right arm portion, the left panel portion and the right panel portion being connected to the back panel portion, and including a releasable fastener for releaseably connecting the arm portions together.

A eight object of the present invention is to provide an infant hugging and comforting device including a vibrating device.

A ninth object of the present invention is to provide an infant hugging and comforting device including a back panel, a left panel portion connected to the back panel portion, a right panel portion connected to the back panel portion, the left panel portion including a left arm portion, the right panel portion including a right arm portion, and including a vibrating device.

A tenth object of the present invention is to provide an infant hugging and comforting device configured to adjustably fit around and hug the chest of an infant including a vibrating device.

The present invention is directed to an infant hugging and comforting device. The device is preferably a soft infant hugging and comforting device.

The infant hugging and comforting device according to the present invention includes the combination of a cloth hugging device, preferably a soft cloth hugging device, configured to fit around the chest of the infant in combination with a vibrating device that is incorporated into the cloth device, or preferably is releaseably connected thereto. For example, the vibrating device can be sewn into pockets of the cloth device, or incorporated into the space between cloth panels, plys or layers of the cloth device, and remain incorporated in the cloth device (e.g substantially not removable). Alternatively, the vibrating device can be inserted into a one or more pockets of the cloth device, or releaseably connected to the cloth hugging device by a fastener, for example, a hook and loop type fastener such as a Velcro fastener.

The infant hugging and comforting device according to the present invention is placed on support surface such as a bed, crib mattress, soft, blanket on floor, pillow, or other suitable support surface. The infant is then laid on top of the infant hugging and comforting device face upwardly, and then the infant hugging and comforting device is wrapped around the sides and front of the infant's chest to hug and comfort the infant.

In a preferred embodiment of the infant hugging and comforting according to the present invention, the device includes a back panel portion, a left panel portion connected to the back panel portion, and a right panel portion connected to the back panel portion. Preferably, the left panel portion includes a simulated left arm portion and the right panel portion includes a right simulated arm portion. The arm portions are connected to a wrap around the sides and front of the infant, and then releaseably connected together. Preferably, a releaseable fastener such as a button, buckle, snap fastener, or preferably a soft hook and loop type fastener such as Velcro are used for releaseably connecting the arm portions together.

In a more preferred embodiment of the infant hugging and comforting device according to the present invention, the arm portions are adjustably connected together to adjust for the size of the infant and the fit of the cloth hugging device on the infant. For example, one arm portion is provided a hand portion having a Velcro strip to cooperate with a Velcro strip on the opposite arm portion or panel portion. For example, strips of Velcro are applied to the front side hand portions of the arm portions, and Velcro strips are applied to both the panel portions and back side of the back panel portion to allow two different points of connection with the hand portions. Additional Velcro strips can be provided to provide additional points of contact for provide for many different size infants using the same device.

In a preferred embodiment of the cloth hugging device, the back panel portion is preferably made of two separate soft cloth plies or layers connected together around the perimeter thereof. In a more preferred embodiment, piping is utilized around the perimeter of the back cloth panel to provide a more finished edge thereof. A left panel portion and a right panel portion are connected to the back panel portion. For example, the left panel portion can be connected at or adjacent the left side edge of the back panel portion, and the right panel portion can be connected along or adjacent a right side edge of the back panel portion. As a particular example, the left panel portion and the right panel portion can be surged to the upper cloth ply of the back panel portion adjacent to the side edges of the back panel portion.

The cloth hugging device according to the present invention can be provided with a vibrating device to further comfort the infant. The vibrating device can be incorporated into one or more of the side panel portions, for example, one or more of the arm portions of the side panel portions. Preferably, the vibrating device is a separate vibrating device releasably connected to the side panel portion, in particular the arm portions of the side panel portions using a fastener. In a preferred embodiment, the vibrating device is enclosed in a separate soft cloth pocket, and a hook and loop fastener is utilized to releaseably connect the vibrating device to different desired positions along the side panels, in particular along the length of the arm portions of the side panel portions.

DETAILED DESCRIPTION OF PREFERRED EMBODIMENTS

Figure 1:
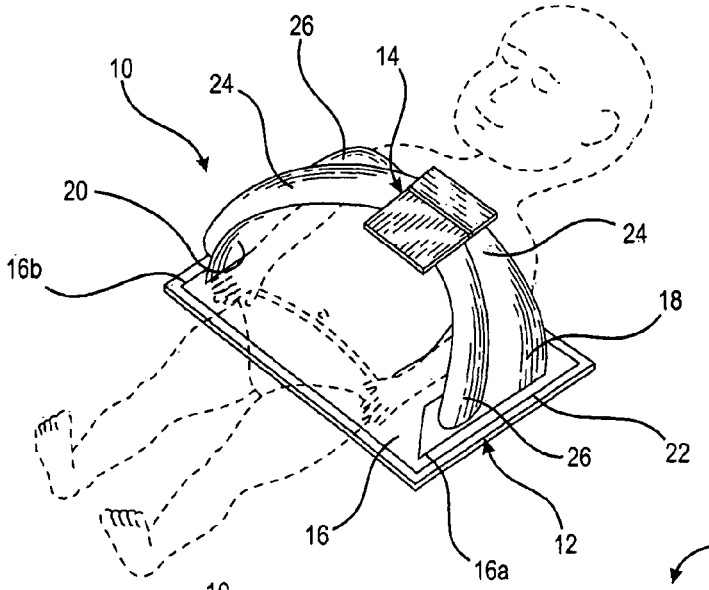
FIG. 1 is a perspective view of a preferred embodiment of an infant hugging and comforting device according to the present invention with an infant shown in ghost image.

A preferred embodiment of the infant hugging and comforting device 10 is shown in FIGS. 1-6.

The infant hugging and comforting device 10 includes the combination of a soft cloth hugging device 12 in combination with a vibrating device 14. Preferably, the vibrating device 14 is a separate device releaseably connected to the soft cloth hugging device 12 to allow the soft cloth hugging device 12 to be cleaned or laundered. However, the vibrating device 14 can be incorporated into the soft cloth hugging device 12 so as to remain a portion thereof. For example, the vibrating device 14 can be enclosed within the two cloth plies or layers making up a panel or portion of the soft cloth hugging device 12.

The soft cloth hugging device 12 includes a back panel portion 16, a left panel portion 18 connected along or adjacent the left side edge of the back panel portion 12, and a right panel portion 20 connected adjacent or along the right side edge of the back panel portion 16. For example, the back panel portion 16 is made of two separate cloth plies or layers stitched together around the perimeter thereof. Piping 22 can be provided around the perimeter of the back panel portion and wrapped around the perimeter edge of the back panel portion 16 and sewn thereto. The left panel portion 18 and the right panel portion 20 can be surged (i.e. by special sewing) to the upper cloth ply or layer of the back panel portion 16 adjacent the side edges 16*a*, 16*b* of the back panel portion 16.

Figure 3:
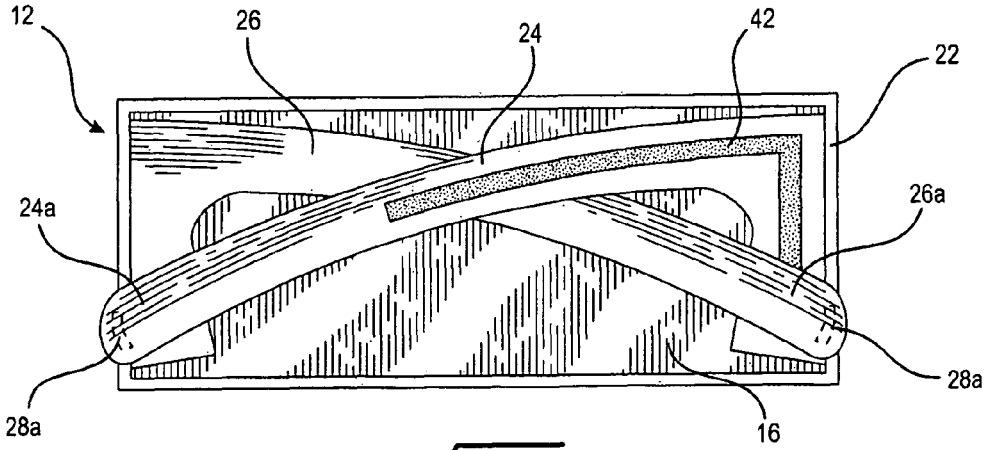
FIG. 3 is a top planar view of the infant hugging and comforting device shown is FIG. 1.

The left panel portion 18 is provided with a simulated left arm portion 24, and the left panel portion 18 is provided with a simulated right arm portion 26, as shown in FIG. 3. The simulated left arm portion 24 is provided with a left hand portion 24*a*, and the simulated right arm portion 26 is provided with a right hand portion 26*a*. The arm portions 24, 26 are configured to criss-cross each other, as shown in FIG. 3, when wrapped around the infant and secured to the side panel portions or back panel portion.

Figure 2:
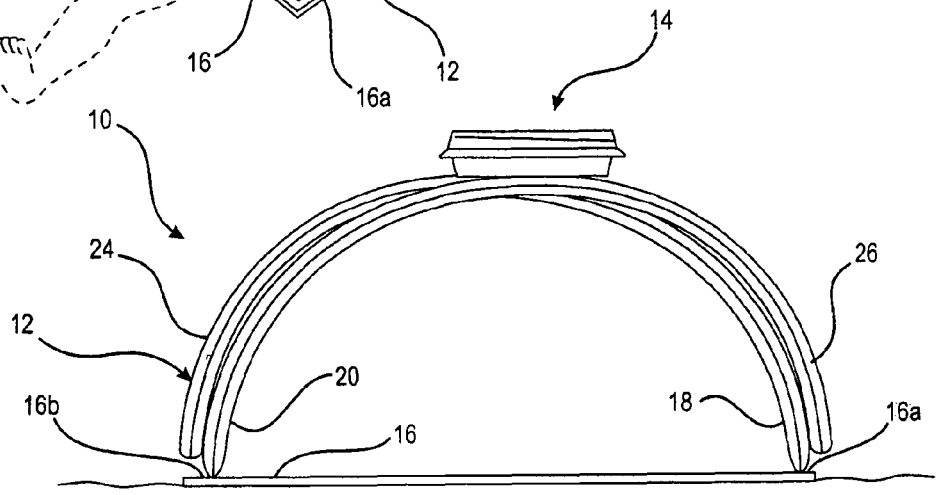
FIG. 2 is a side elevational view of the infant hugging and comforting device shown in FIG. 1.

The left panel portion 18 and corresponding simulated left arm portion 24, and right panel portion 20 and corresponding simulated right arm portion 26, for example, are made of two cloth plies or layers stuffed with a soft filling material such as batting material. Again, the back panel portion 16, for example, can be made of two soft cloth plies or layers, however, is preferably not filled so as to lay substantially flat with little to no rise, as shown on top of a support surface S (e.g. bed, crib, mattress, couch, pillow, floor), as shown in FIG. 2.

Figure 5:
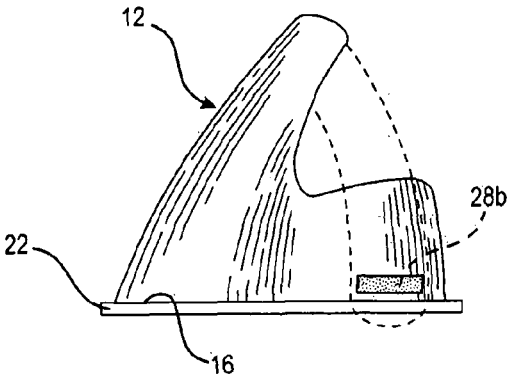
FIG. 5 is a right side elevational view of the infant hugging and comforting device shown in FIG. 1, shown with the arm portions connected together.
Figure 6:
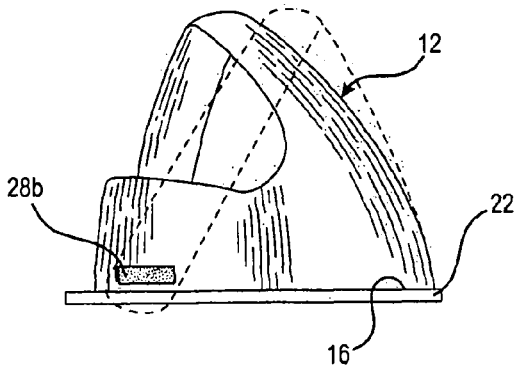
FIG. 6 is a left side elevational view of the infant hugging and comforting device shown in FIG. 1, shown with the arm portions connected together.

The left hand portion 26*a* is provided with a hook and loop type fastener 28*a* provided on the inside of the front side of the left hand portion 26*a*, and another hook and loop type fastener 28*a* provided on the front side of the right hand portion 26*a*, as shown in FIG. 3. The hook and loop type fasteners 28*a*, 28*a* of the hand portions 24*a*, 26*a* releaseably connect with hook and loop type fasteners 28*b*, 28*b* provided on the left side panel portion 18 and right panel portion 20, respectively, as shown in FIGS. 5 and 6. Specifically, the hook and loop type fasteners 28*b*, 28*b* are sewn to an outer side of the left side panel portion 18 and right panel portion 20 as shown.

Figure 4:
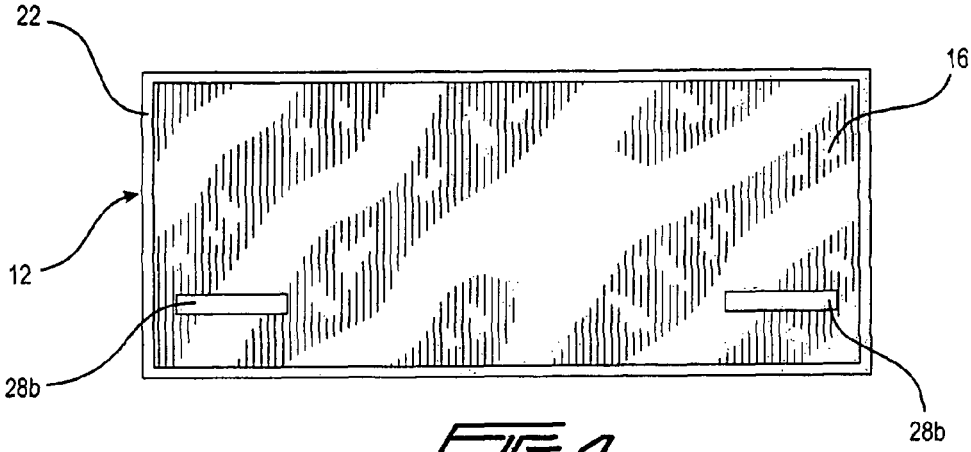
FIG. 4 is a bottom planar view of the infant hugging and comforting device shown in FIG. 1 with the arm portions laid open readied to receive the infant.

The back panel portion 16 can be provided with an additional set of hook and loop type fasteners 28*b*, 28*b*, as shown in FIG. 4. The additional set of hook and loop type fasteners 28*b*, 28*b* can be provided on the back side of the back panel portion 16 to provide an alternative position for securing the hook and loop type fasteners 28*a*, 28*b* of the hand portions 24*a*, 26*a*, as shown in FIG. 3. Specifically, for a small infant (e.g. new born infant or premature infant), the arm portions 24, 26 can be wrapped around the edges of the back panel portions 16 and secured to the alternative hook and loop type fasteners 28*b*, 28*b*, as shown in FIG. 4 to provide for the smaller torso of the small infant. In such case, the side ends of the back panel portion are wrapped around the sides of the infant again with the arms portions 24, 26 wrapping around the side edges of the back panel portion reaching the back side of the back panel portions 16 to secure to these alternative hook and loop type fasteners 28*b*, 28*b*.

Figure 7:
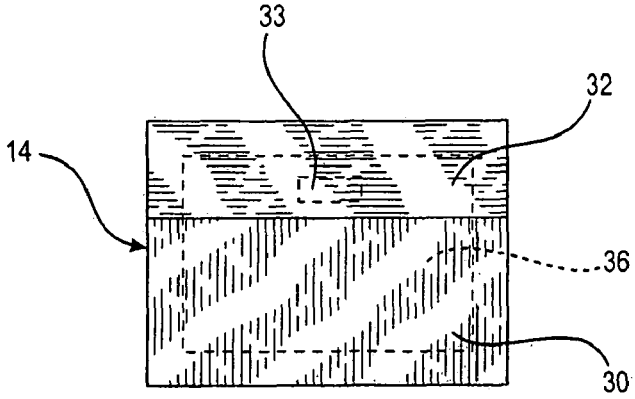
FIG. 7 is a top planar view of the vibrating device according to the present invention with a battery operated vibrator located in a separate envelop readied to be attached to the cloth hugging device of the infant hugging and comforting device according to the present invention.
Figure 8:
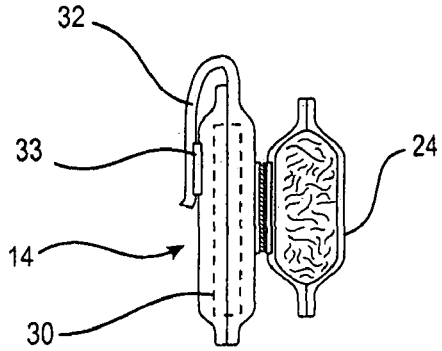
FIG. 8 is a side elevational view of the infant hugging and comforting device showing the attachment of the vibrating device to the infant hugging and comforting device.

A vibrating device 14 according to the present invention is shown in FIG. 7.

The vibrating device 14 includes a soft cloth envelope 30 having a releasable flap 32, for example, provided with a hook and loop type fastener 33 for releaseably closing and opening the flap 32. A two part Velcro strip can be provided for such purpose. A vibrator 36 is placed within the envelope 30, and closed shut with the flap 32 using the hook and loop fastener 33. The vibrator 36 is preferably a battery operated vibrator having an on and off switch.

Figure 9:
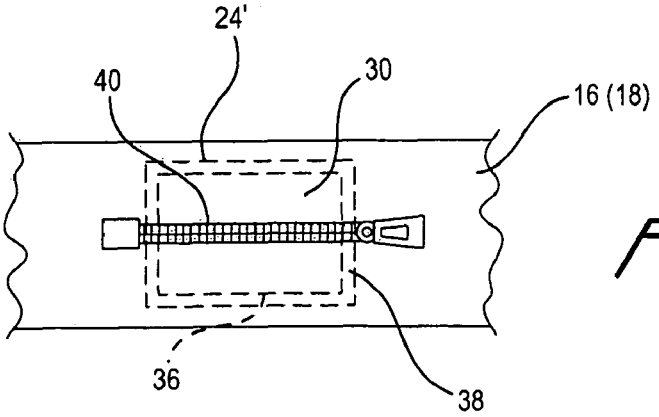
FIG. 9 is a back side view of a side panel portion having a zippered pocket for accommodating a vibrating device.

As an alternative to the separate vibrating device 14, the vibrator 36 can be located in a pocket 38 having a zipper 40 provided in one or both side panel portions 16, 18, for example, in the arm portions 24, 26 as shown in FIG. 9. The zipper 40 is opened and the vibrator 36 is placed therein, and then the zipper 40 is pulled shut. In this manner, the vibrator 36 is removable, for example, for washing the soft cloth hugging device 12.

As a further alternative, as shown in FIG. 3, the left arm portion 24 is provided with an L-shaped hook and loop fastener strip 42. A hook and loop fastener is provided on the back side of the vibrating device 14 to releaseably connect the vibrating device 14 at any position along the L-shaped hook and loop fastener strip 42. Moving the vibrating device 14 to different positions allows adjustment of the comforting of the particular infant. The right arm portion 26 can also be provided with a similar L-shaped hook and loop fastener.

OPERATION

The cloth hugging device 12 is placed on a suitable support surface with the arm portions 24, 26 opened and disconnected. An infant face up is then laid down onto the cloth hugging device 12, and the back of the infant's chest is positioned over the back panel portion 16.

The right arm portion 26 is wrapped over the top of the chest of the infant, and the hand portion 26*a* is secured to the left panel portion 18 using the hook and loop fasteners 28*a*, 28*b*. Then, the left arm portion 24 is wrapped over the top of the chest of the infant on top of the right arm portion 26 and criss-crossing thereof, and then the hand portion 28*a* is secured to the right panel portion 20 using the hook and loop fasteners 28*a*, 28*b*.

The vibrator 36 is turned on, and then inserted into envelop 30 to provide the vibrating device 14. The vibrating device 14 is then connected along the L-shaped hook and loop fastener 42, at a suitable position. The infant just lays there while be comforted by both being hugged (i.e. swaddled) and the vibrating device 14 vibrates the infant's chest to sooths the infant so that the infant relaxes, feels comfortable, and the rests or falls asleep. After use, the vibrating device 14 is removed, and the arm portions 24, 26 are disconnected to then remove the infant from the device.

I claim:

1. A soft infant hugging and comforting device for use on a support surface such as a bed, said device comprising:

a rectangular-shaped soft back panel configured to accommodate a back of an infant's chest on top thereof when laying an infant down onto said device lying on the support surface with the infant's head located above said back panel and infant's legs located below said back panel, said back panel including a soft fabric upper panel portion and a soft fabric lower panel portion connected together at a perimeter thereof by piping covering perimeter edges of said upper and lower panel portions sewn together;

a left side panel configured to accommodate a side of the infant's chest, said left side panel surged to said upper panel portion of said back panel adjacent to a left side edge of said back panel, said left side panel including an outwardly extending left arm portion configured to wrap around a front of the infant's chest, said left side panel including a soft fabric upper panel portion and a soft fabric lower panel portion sewn together at a perimeter thereof, said left side panel stuffed with a soft filling material;

a right side panel configured to accommodate a side of the infant's chest, said right side panel surged to said upper panel portion of said back panel adjacent to a right side edge of said back panel, said right side panel including an outwardly extending right arm portion configured to wrap around the front of the infant's chest, said right side panel including a soft fabric upper panel portion and a soft lower panel portion sewn together at a perimeter thereof, said right side panel stuffed with a soft filling material;

a vibrating device removably connected to one of said side panels, said vibrating device provided with one portion of a hook and loop fastener adhered to said vibrating device and another portion of said hook and loop fastener sewn to one of said panels; and an adjustable fastener including a fastener portion connected to a left hand portion of said left arm portion, another fastener portion connected to a right hand portion of said right arm portion, said fastener portions configured to allow said arm portions to wrap around the front of the infant's chest to adjust for the size and fit of a particular infant when placing the infant face up in said device and wrapping said arm portions around a front of the infant's chest and releaseably connecting ends of said arm portions to said device to restrain the infant, and said one of said arm portions including an L-shaped hook and loop fastener to allow said vibrating device to be selectively positioned at a variety of positions along said L-shaped hook and loop fastener and to connect to one of said fastener portions of the other of said arm portions.

2. A soft infant hugging and comforting device for use on a support surface such as a bed, said device comprising:

a rectangular-shaped soft back panel configured to accommodate a back of an infant's chest on top thereof when laying an infant down onto said device lying on the support surface with the infant's head located above said back panel and infant's legs located below said back panel;

a left side panel configured to accommodate a side of the infant's chest, said left side panel connected to a left side of said back panel, said left side panel including an outwardly extending left arm portion configured to wrap around a front of the infant's chest;

a right side panel configured to accommodate a side of the infant's chest, said right side panel connected to a right side said back panel said right side panel including an outwardly extending right arm portion configured to wrap around the front of the infant's chest;

a vibrating device releaseably connected to one of said side panels; and an adjustable fastener including a fastener portion connected to said left arm portion, another fastener portion connected to said right arm portion, said fastener portions configured to allow said arm portions to be connected at different locations on opposite side panel portions or said back panel portion to adjust for the size and fit of a particular infant when placing the infant face up in said device and wrapping said arm portions around the front of the infant's chest and releasably connecting ends of said arm portions to said device to restrain the infant, and said one of said arm portions including an L-shaped fastener to allow said vibrating device to be selectively positioned at a variety of positions along said L-shaped fastener and to connect to one of said fastener portions of the other of said arm portions.

3. An infant hugging and comforting device for use on a support surface such as a bed, said device comprising:

a back panel configured to accommodate a back of an infant's chest on top thereof when laying an infant down onto said device lying on the support surface;

a left side panel configured to accommodate a side of the infant's chest, said left side panel connected to a left side of said back panel, said left side panel including an outwardly extending left arm portion configured to wrap around a front of the infant's chest;

a right side panel configured to accommodate a side of the infant's chest, said right side panel connected to a right side of said back panel, said right side panel including an outwardly extending right arm portion configured to wrap around the front of the infant's chest;

a vibrating device associated with said device; and an adjustable fastener connected to said arm portions, said adjustable fastener configured to allow said arm portions to be adjustably connected at different locations on said device to adjust for the size of the infant and fit of the infant when placing the infant face up in said device and wrapping said arm portions around the front of the infant's chest and releasably connecting ends of said arm portions to said device to restrain the infant, and said one of said arm portions including an L-shaped fastener to allow said vibrating device to be selectively positioned at a variety of positions along said L-shaped fastener and to connect to one of said fastener portions of the other of said arm portions.

4. A device according to claim 3, wherein said adjustable fastener is a hook and loop type fastener.

5. A device according to claim 4, wherein a strip of one portion of said hook and loop type fastener is sewn onto said left side panel and a strip of another portion of said hook and loop fastener is sewn onto said right side panel.

6. A device according to claim 4, wherein said strip of one portion of said hook and loop fastener is sewn onto one of said arm portions and said strip of another portion of said hook and loop fastener is sewn onto the other arm portion.

7. A device according to claim 6, wherein said strip of one portion of said hook and loop fastener is sewn transversely on a hand portion of one of said arm portions and said strip of another portion of said hook and loop fastener is sewn lengthwise onto said other arm portion to provide an adjustable fastener for accommodating the size of the infant and the fit of the infant when said arm portions are wrapped around the infant and releaseably connected together.

8. A device according to claim 3, wherein said back panel is a rectangular-shaped soft back panel including a soft fabric upper panel portion and a soft fabric lower panel portion connected together at a perimeter thereof by piping covering perimeter edges of said upper and lower panel portions.

9. A device according to claim 3, wherein said side panels include a soft fabric upper panel portion and a soft fabric lower panel portion sewn together at a perimeter thereof, said side panels being stuffed with a soft filling material.

10. A device according to claim 3, wherein said back panel is a rectangular-shaped soft back panel configured to accommodate a back of an infant's chest on top thereof when laying an infant down onto said device lying on the support surface with the infant's head located above said back panel and infant's legs located below said back panel, said back panel including a soft fabric upper panel portion and a soft fabric lower panel portion connect together at a perimeter thereof by piping covering perimeter edges of said upper and lower panel portions sewn together.

11. A device according to claim 10, wherein said strip of one portion of said hook and loop fastener is sewn transversely on a hand portion of one of said arm portions and said strip of another portion of said hook and loop fastener is sewn lengthwise onto said other arm portion to provide an adjustable fastener for accommodating the size of the infant and the fit of the infant when said arm portions are wrapped around the infant and releaseably connected together.

12. A device according to claim 3, wherein said vibrating device is a separate vibrating device connected to said infant hugging and comforting device.

13. A device according to claim 12, wherein one of said side panels is provided with a pocket for accommodating said separate vibrating device.

14. A device according to claim 12, wherein said vibrating device is removeably connected to one of said side panels.

15. A device according to claim 14, wherein said vibrating device is removeably connected to one of said side panels by a hook and loop fastener.

* * * * *